United States Patent [19]

Niehaus et al.

[11] 4,018,256

[45] Apr. 19, 1977

[54] ADJUSTABLE DADO HEAD

[75] Inventors: Edward J. Niehaus, Tupelo, Miss.; James R. Hosack, Guelph, Canada

[73] Assignee: Rockwell International Corporation, Pittsburgh, Pa.

[22] Filed: Feb. 5, 1976

[21] Appl. No.: 655,630

[52] U.S. Cl. ..... 144/238; 29/105 R; 83/698; 144/218

[51] Int. Cl.[2] ..... B27B 33/00

[58] Field of Search ..... 144/218, 238, 323, 222; 29/105 R, 104; 83/666, 698, 838

[56] References Cited

UNITED STATES PATENTS

| | | | |
|---|---|---|---|
| 1,568,199 | 1/1926 | Watson | 144/238 |
| 2,544,814 | 3/1951 | Warren | 144/238 |
| 3,780,780 | 12/1973 | Pettigrew et al. | 144/238 |

*Primary Examiner*—Othell M. Simpson
*Assistant Examiner*—W. D. Bray

[57] ABSTRACT

This invention pertains to an adjustable dado head with positive positioning means in the assembly of the respective parts, making it impossible to misalign parts during assembly. Some of the positioning means also act as fasteners to hold the parts in assembled relation.

4 Claims, 10 Drawing Figures

ADJUSTABLE DADO HEAD

BACKGROUND OF THE INVENTION

The present invention discloses a device that can only be assembled in the correct way, from economical parts containing alignment means which also acts as the means for holding parts together in assembled relation.

Other adjustable dado assemblies are well known. For example, U.S. Pat. No. 2,683,476 to Courcier, discloses a dado head in which the cutters are mounted on a core plate which is then surrounded with cast metal to make an integral clamping plate and blade sub-assembly, a most expensive and irreversible process.

Another well-known assembly is disclosed in U.S. Pat. No. 3,159,191 to Sam. This device has a pair of cooperating external plates pinned together to act as a spool sub-assembly, and a pair of clamping plates and blade pinned together, along with a sleeve member forming a clamping plate sub-assembly. The sleeve member has an internal flange member that clamps between portions of the spool sub-assembly.

OBJECTS OF THE INVENTION

It is a principal object of this invention to provide an economical, easily assembled cutting assembly which is adjustable to cut grooves of various widths.

It is another object of this invention to provide an assembly which requires a minimum number of different parts, but which is impossible to assemble improperly.

It is yet another object to provide an adjustable dado head which is easy to use and adjust for a wide range of different width cuts.

DESCRIPTION OF THE PREFERRED EMBODIMENT

Generally speaking, this invention contemplates a saw blade with an enlarged central hole, being mounted upon a pair of inner side plates by means which assures correct assembly, this sub-assembly in turn being mounted upon a split spool sub-assembly. The complete assembly is designed to be mounted upon the arbor of a table saw or radial arm saw and is adjustable for the desired width of dado cut without removal from the arbor.

Figure 1:
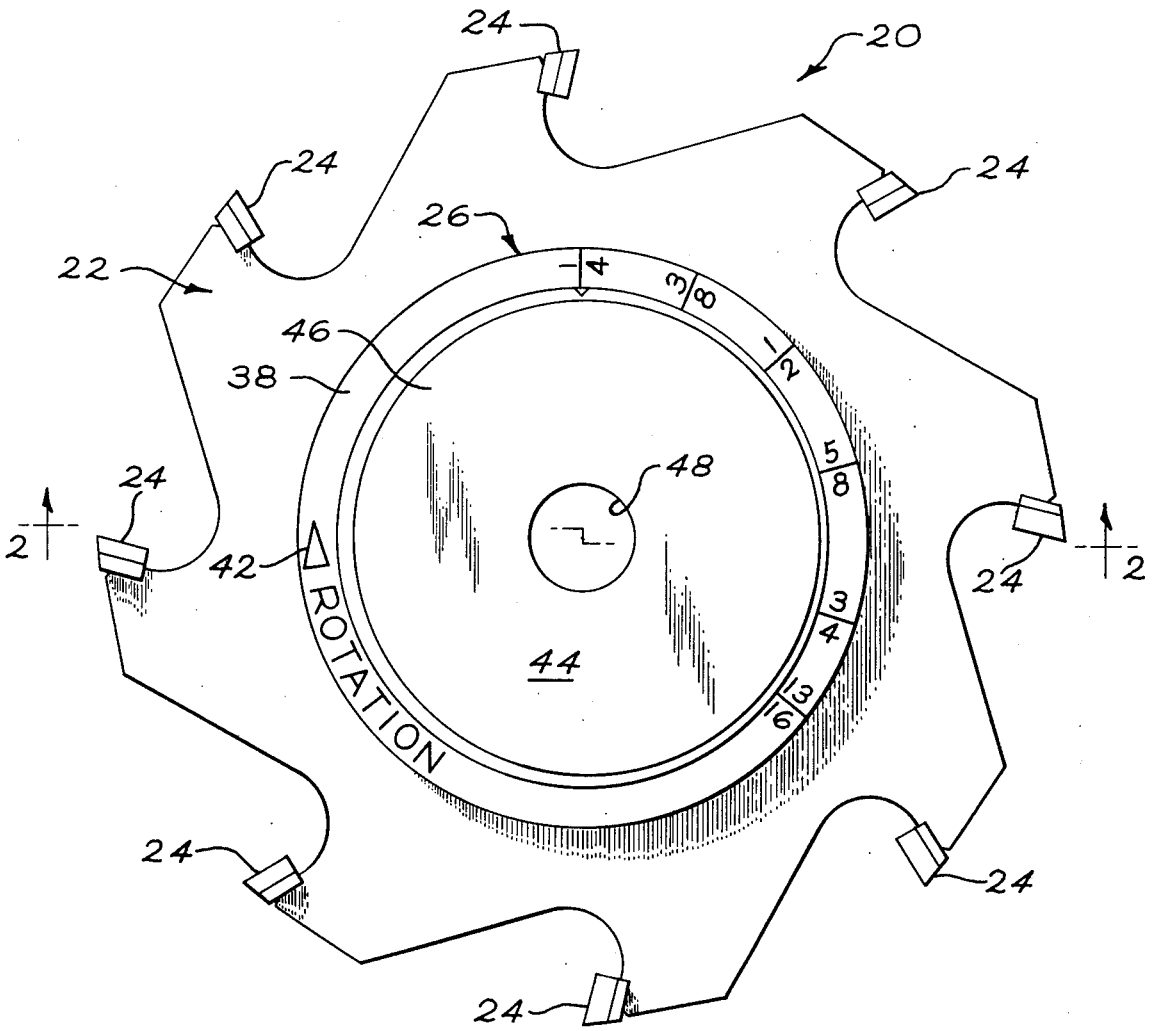
FIG. 1 is a side view of the dado assembly of the present invention.
Figure 2:
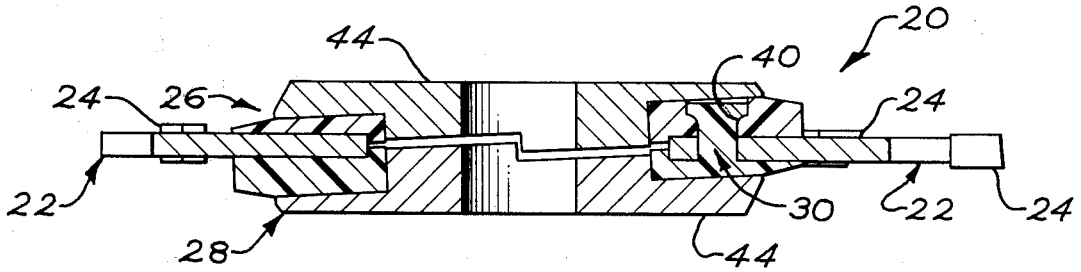
FIG. 2 is a section along line 2—2 of FIG. 1.

Referring to the drawings, a side view of the assembled cutter 20 is shown in FIG. 1, while a sectional view of the assembly is shown in FIG. 2. The blade 22 is flat and of a thickness customary in power saw blades, and has mounted on suitably shaped projections a plurality of cutting bits 24. These cutting bits 24 project outwardly from the periphery of blade 22 and are secured in recesses formed in the projections by any suitable means. In this embodiment carbide cutters are used and they are fixed in place with a fusion paste. The cutters are mounted with the side cutting edge (radial to the axis of the blade) on the side toward which the assembly is moving during operation, in a well-known arrangement. The blade 22 has a large central bore for mounting the remainder of the assembly, and a pair of smaller holes through the body of the blade for a purpose to be discussed later.

Figure 3:
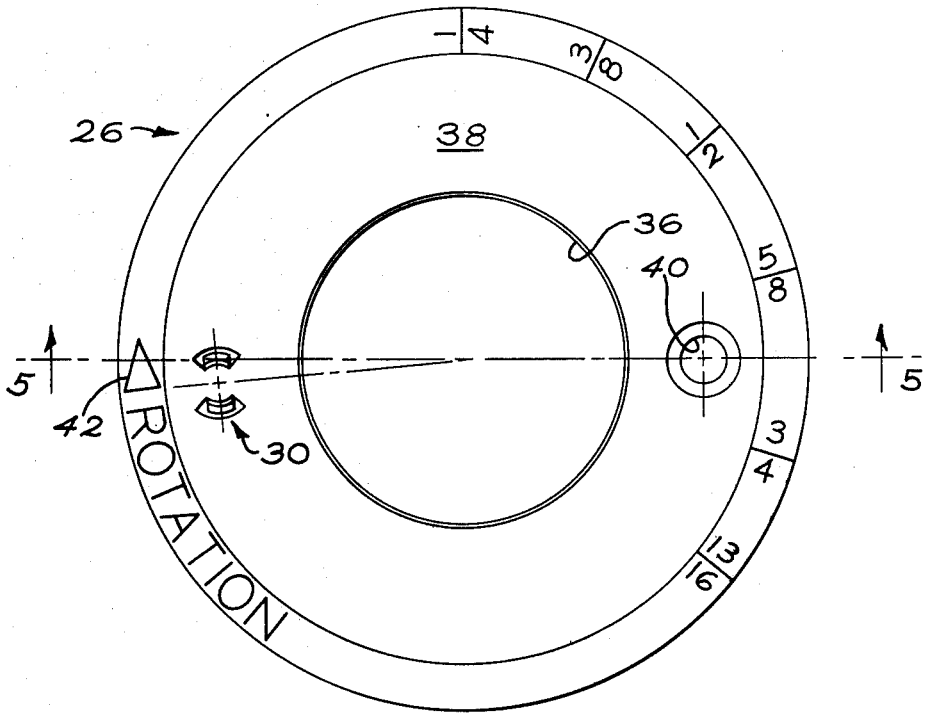
FIG. 3 is a side view of the left-hand inner side plate.
Figure 4:
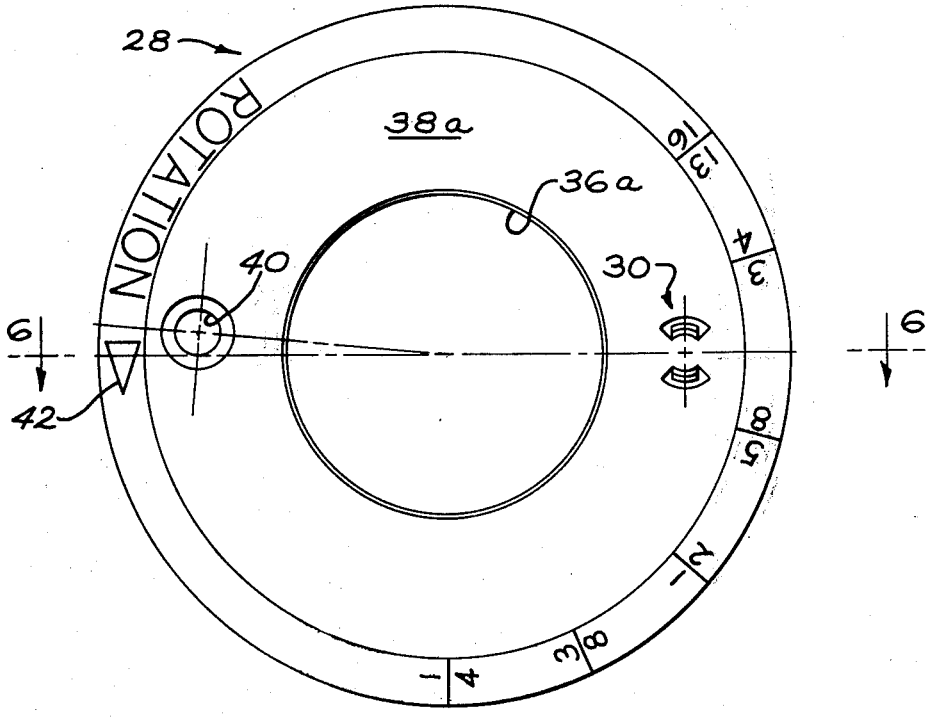
FIG. 4 is a side view of the right-hand inner side plate.
Figure 5:
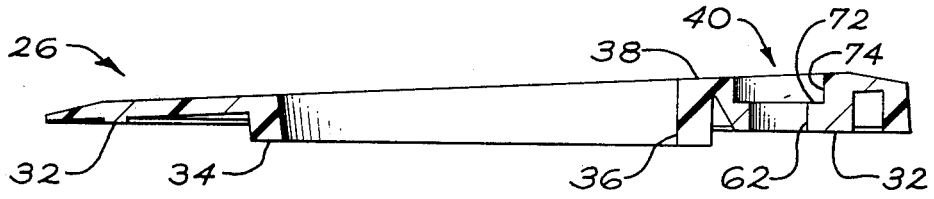
FIG. 5 is a sectional view along 5—5 of FIG. 3.

In this description of the invention, "left-hand side" and "right-hand side" will be used as viewing the assembly, from the right side of FIG. 1 — in other words, as viewing the dado assembly from the operator's position when the dado head is mounted on a table saw arbor. In this orientation, FIGS. 3 and 5 show the left-hand inner side plate 26, which is also shown on the assembly of FIG. 1, while the right-hand inner side plate 28 is seen in FIGS. 4 and 6.

Figure 6:
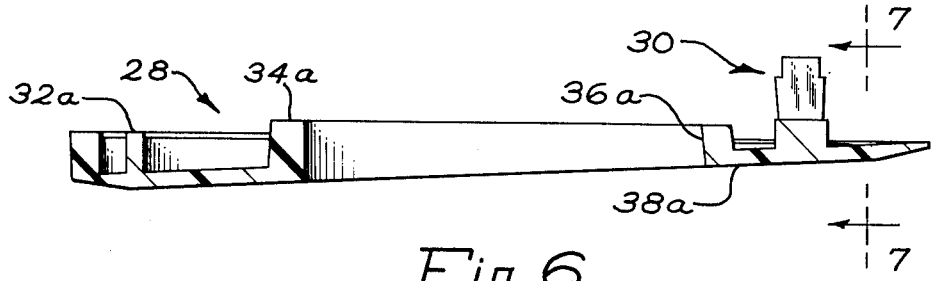
FIG. 6 is a sectional view along 6—6 of FIG. 4, inverted to better show the match with FIG. 5.
Figure 7:
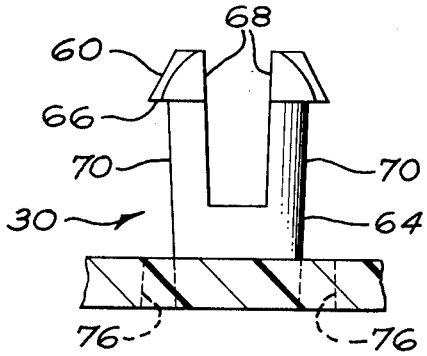
FIG. 7 is a partial sectional view along 7—7 of FIG. 6, showing one form of fastener for holding the inner side plates together.
Figure 8:
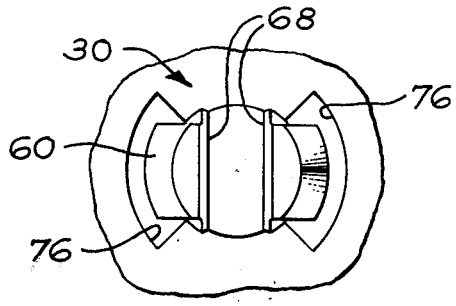
FIG. 8 is a top view of the fastener of FIG. 7.

The blade is fastened between two inner side plates 26 and 28 by fasteners 30, one of which is shown in FIGS. 6, 7 and 8. The fasteners in this embodiment are molded integrally with the side plates, one on each side plate, and they pass through the small holes in the blade 22 mentioned above, and into a counterbored hole in the other side plate. These inner side plates 26 and 28 are preferably molded of a synthetic resin or the like having the properties of sufficient resiliency to allow the fasteners to snap into place in the counterbores, yet rigid enough to retain the blade in the desired alignment.

The left-hand inner side plate 26 has a flat inner surface 32 which abuts the left side of blade 22. A hub 34 is provided to mount the center bore of blade 22. Through this hub is bore 36 which is perpendicular to outer face 38 of side plate 26. The inner face 32 and outer face 38 of the side plate form an acute angle which is determined by the amount of wobble desired - the range of cutting widths.

Right-hand inner side plate 28 also has a flat inner surface **32*a* which abuts the right-hand side of blade 22, a hub 34*a*, the end of which abuts hub 34 of left-hand inner side plate 26, and a central bore 36*a* which is co-axial with bore 36 of plate 26. The inner face 32*a* of side plate also forms an acute angle with outer face 38*a*, but the apex of the angle is 180° around from the apex of inner side plate 26**.

Provision is made to prevent assembling the inner side plates 26 and 28 incorrectly on blade 22. In this case, as seen in FIGS. 3 and 4, the fasteners 30 and the counterbored matching holes 40 which receive the fasteners are located other than 180° apart. This means that inner side plates 26 and 28 will only assemble on blade 22 in one configuration; i.e., with the narrowest part of the inner side plate on the side of the blade having the side cutting edges projecting for cutting. In addition, to assure the proper markings 42 (correct direction of rotation), the fasteners 30 and matching holes 40 can be placed at different radial distances from the axis of rotation of the assembly. Thus, the inner side plate for each side would have to match the blade in three places; the large central bore 36, the fastener 30 would have to match the corresponding hole in the blade, and the hole 40 would have to align with the other hole in the blade 22, to receive the fastener from the other inner side plate. Thus, the inner side plates and the blade can only be assembled in one way.

Figure 9:
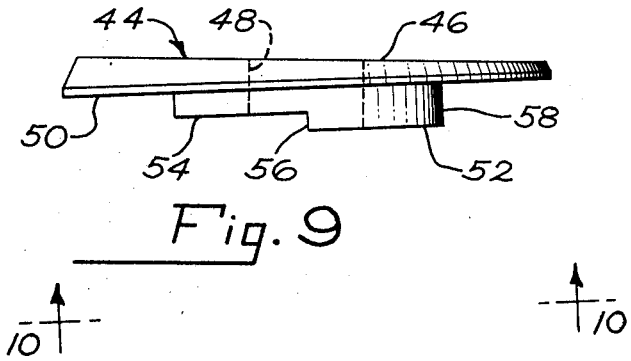
FIG. 9 is a front view of one of the outer side plates.
Figure 10:
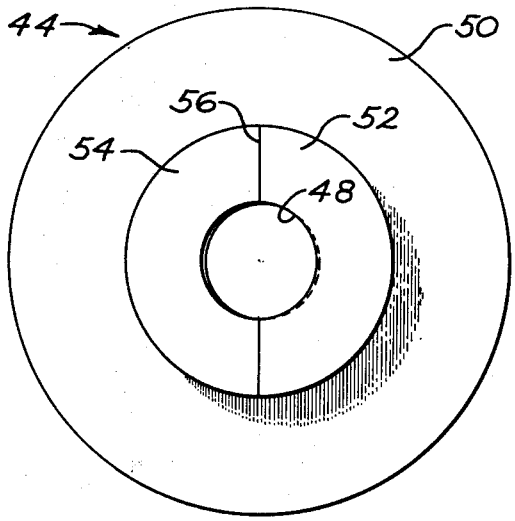
FIG. 10 is a side view of the inner side of one of the outer side plates.

This inner sub-assembly, after being snapped together, is mounted upon a pair of outer side plates 44, best seen in FIGS. 9 and 10. These plates are identical to each other, so only one will be described here. The outer side plates are also wedge-shaped in a cross-sectional view of the inner and outer surfaces. The outer face 46 is perpendicular to center bore 48, and bore 48 is designed to fit a saw arbor. The inner surface 50 is formed at the same acute angle to outer face 46 as formed by inner face 32 and outer face 38 of the inner side plates. To properly position the pair of outer side plates, the inwardly-directed hubs 52 on which the inner side plates ride, are made with recessed protions 54. This recessed portion 54, upon assembly, then abuts the portion 52, and the shoulder 56 abuts a like shoulder on the other outer side plate. When in assembled position, the pair of outer side plates act together, due to the mating shoulders 56 interacting. The outer periphery 58 of hub 52 is dimensioned to closely receive the bore 36 of the sub-assembly of inner side plates and blade 22, so that the sub-assembly is rotatable upon hubs 52 when the two outer side plates are inserted from either side, and are clamped in a preset wobble position when the arbor nut of a saw is tightened upon the arbor, against one of the outer side plates 44.

To return to the fasteners 30 used to keep inner side plates, attention is directed to FIGS 6, 7 and 8. These fasteners are molded integrally with the side plates 26 and 28, one on each in this embodiment. These fasteners, as stated above, are molded of a material with sufficient resiliency that the enlarged head 60 of the fastener is deformed inwardly upon insertion into the bottom portion 62 of counterbored holes 40, the height of the stem 64 of fastener 30 is designed so the blade and small bore portion 62 of counterbored hole 40 is equal to the stem height to shoulder 66 on the bottom of enlarged head 60. In order to provide clearance for the head 60 to deform inwardly, a slot 68 is provided. This allows the resulting legs 70 to bend toward each other as head 60 is pushed through the small bore bottom portion 62 of counterbored hole 40. Upon the shoulder 66 clearing the shoulder 72 in the opening 40, the legs 70 snap the head into the larger bore 74 and shoulder 66 engages shoulder 72 to retain the sub-assembly in proper position.

The head 60, to facilitate passage through the small bore 62 of hole 40, has the faces at right angles to the slot 68 flattened and preferably slightly smaller than the diameter of the stem 64. This head 60 has a height less than the height of the portion of the counterbore from shoulder 72 to the outer face of the inner side plate, so that the head 60 does not project into the plane of the outer face.

The markings 42 referred to briefly above, are preferably cast integrally with the inner side plates, and a scribed line to indicate the width of cut is cast integrally with the outer side plates. The numerals indicate the width in fractions of an inch at the present time, and the arrow for the direction of rotation is placed so that it points in the direction of cutting of the teeth.

From the foregoing description of the invention in which a preferred embodiment is described, it will be seen that an adjustable dado assembly is disclosed which can only be assembled in the correct operating interaction of parts. The placement of the openings for the fasteners and the shouldered hub of the outer side plates compels the parts to be assembled properly.

Accordingly, we claim:

1. A tool rotatable about an axis for milling a groove in a workpiece, comprising a cutter head assembly including a blade having flat opposite faces, a large aperture centrally thereof, and a multiplicity of openings for through fasteners, a pair of clamping plates formed with an aperture centrally thereof and having parallel outer surfaces and complementary inner surfaces inclined relative to said outer surfaces, said plates being positioned on opposite sides of said blade with their inner surfaces against said blade faces, fastening means between said clamping plates and through said openings in said blade to firmly clamp said clamping plates and said blade together as a sub-assembly; a spool sub-assembly including side plates having parallel outer surfaces and complementary inner surfaces inclined relative to said end plate outer surfaces and bearing against the parallel outer surfaces of said clamping plates, hub portions on said side plates and extending towards each other within the apertures of said clamping plates, said side plates having means therewith to prevent relative rotation thereof, and a bore extending through said hub portions adapted to receive a shaft, said blade and clamping plates sub-assembly being mounted on said hub portions between the inclined inner surfaces of said spool side plates for rotation relative to said spool sub-assembly, said clamping plates being firmly fastened to either side of said blade by means permitting assembly in one orientation only.

2. The tool of claim 1, wherein said means permitting assembly in one orientation being a pair of fasteners oriented at other than 180° intervals arcuately about the axis of said tool.

3. The tool of claim 2, wherein said fasteners are positioned to assure assembly with said blade in one orientation only, whereby the cutting edges of said blade are properly oriented.

4. The tool of claim 2, wherein said fasteners are resilient bifurcated prongs having enlarged heads which are received in recesses in the complementary clamping plates.

* * * * *